US006056086A

United States Patent [19]

Gortan et al.

[11] Patent Number: 6,056,086

[45] Date of Patent: May 2, 2000

[54] DEVICE FOR AUTOMATICALLY STOPPING THE FALL OF PERSONNEL WORKING HIGH ABOVE GROUND

[75] Inventors: Guido Gortan, Hellange, Luxembourg; Maksimiljan Cencic, Yutz, France

[73] Assignee: Tractel, S.A., France

[21] Appl. No.: 09/043,176

[22] PCT Filed: Jul. 15, 1997

[86] PCT No.: PCT/FR97/01305

§ 371 Date: Mar. 16, 1998

§ 102(e) Date: Mar. 16, 1998

[87] PCT Pub. No.: WO98/02210

PCT Pub. Date: Jan. 22, 1998

[30] Foreign Application Priority Data

Jul. 16, 1996 [FR] France ..... 96 08841

[51] Int. Cl.[7] ..... A62B 1/20

[52] U.S. Cl. ..... 182/197; 182/234

[58] Field of Search ..... 182/192, 191, 182/5, 234, 193; 188/188, 65.4

[56] References Cited

U.S. PATENT DOCUMENTS 5,638,919 6/1997 Pejout ..... 182/192

FOREIGN PATENT DOCUMENTS 1301417 4/1987 U.S.S.R. ..... 182/5

*Primary Examiner*—Alvin Chin-Shue

*Attorney, Agent, or Firm*—William A. Drucker

[57] ABSTRACT

The device comprises, inside a case, a tightening cam (7) hinged about an axis (8) such that, unused, it does not engage a belaying rope (2) passing through the case and, when the device is subjected to a set acceleration downwards, it pivots towards the rope (2) to tighten it to the case with self-tightening effect. On the cam (7) is mounted a detecting roller (10) which co-operates with the rope (2) when the cam (7) is unused. A spring actuated (13) friction piece (12), at a certain rotational speed of the roller (10), subjects it to a resisting moment which triggers off the pivoting of the cam (7) in the tightening direction. A lever (15), to which the user is linked, engages in a unidirectional manner the cam (7) to push it in tightening position if the user falls. The device simultaneously triggers off several tightening effects in case of a fall.

6 Claims, 2 Drawing Sheets

DEVICE FOR AUTOMATICALLY STOPPING THE FALL OF PERSONNEL WORKING HIGH ABOVE GROUND

FIELD OF THE INVENTION

The present invention concerns an individual anti-fall protective device and more particularly a device designed to automatically stop the fall of a person working above ground level.

BACKGROUND OF THE INVENTION

There are several individual anti-fall protective devices sliding on a support, such as a rope, orientated vertically and fixed at its upper portion.

These devices are connected by a head rope to an operator when they are intended to protect the latter from falling.

To this effect, these devices have been designed so as to slide upwards and downwards along the support and able to lock on the latter should the operator fall.

Some of the models of these devices are complicated and tighten an element on the support under the dynamic effect caused by a fall of the operator connected to the device.

The most advanced models do have the drawback of comprising a large number of fragile elements. Most of these devices mean that constant vigilance is required to ensure they are clean as they are sensitive to the presence of debris and dust which adversely affect their operational efficiency.

The U.S. Pat. No. 4,923,037 describes an automatic anti-fall stoppage device able to move along a vertical support. This device includes a mounted toothed wheel for rotating inside its housing joined to the inside of an external housing and is elastically stressed in a direction applying the toothed wheel against the support passing into a vertical channel fitted at the front portion of the external housing. When the device moves along the support, the toothed wheel is rotary-driven via its friction on the latter. If the fall speed of the device along the support reaches a predetermined value, the corresponding speed of rotation of the toothed wheel triggers a centrifugal clutch mechanism which stops rotation of the toothed wheel. The friction between the support and the stopped toothed wheel then causes the housing to pivot in a direction ensuring the tightening of the support between the toothed wheel and the external housing and locking of the device on the support.

In this device, where the toothed wheel is used both to detect the moving speed of the device and as a tightening element, the centrifugal clutch system, which triggers automatic tightening, is a costly and fragile element sensitive to dust.

The French patent published under the N° 2574511 also concerns a device for automatically tightening on a safety rope. This device includes a roller able to move along a ramp between a lower rest position, in which it is distanced from the safety rope, and an upper position where it tightens the rope so as to lock the device on the latter. A lever, hooked to the head rope connected to the user, engages the mobile roller under the dynamic effect of a fall of the user so as to bring it to a position enabling it to be tightened.

Owing to the lightness of the tightening roller able to rise along the guiding ramp under the effect of jerks or vibrations, this device is extremely sensitive to poorly controlled functioning and is likely to function erratically.

SUMMARY OF THE INVENTION

The aim of the present invention is to provide an automatic anti-fall device avoiding the drawbacks mentioned above of known types of devices and has the advantages of simplicity, sturdiness and improved efficiency.

To this end, the device is embodied by a small number of elements having simple shapes cooperating together to simultaneously implement three modes for triggering the tightening effect on the support:

- via the acceleration of a detector element situated on the tightening element and which starts its tightening movement,
- via the embodiment of the tightening element in the shape of a tightening cam mounted in such as way so that the position of its centre of gravity with respect to its spin axis provokes an inertial effect should the device be suddenly stressed downwards which activates tightening of the cam,
- via the action of a lever under the effect of the load.

According to the invention, the automatic anti-fall device, which slides without requiring any additional operation onto a safety support fixed at a point situated above said device connected to the user or a load, is of the type comprising an element for tightening the safety support and an element for detecting an acceleration threshold or the moving speed of the safety support with respect to the device. It is characterised in that the detector element, constituted by a roller or an equivalent rotary element, and the tightening element are separate elements, the detecting element being mounted on the tightening element and driving the latter in the direction of tightening under the effect of a resistant torque with a specific level opposing the rotation of the roller, said resistant torque being generated by a device secured to the tightening element and acting on the basis of a specific threshold of the speed or acceleration of the safety support in the device.

The device generating the resistant torque is preferably formed of a friction piece or cam applied against the roller under the effect of a spring pressing on the safety element and generating a resistant torque increasing with the speed of the support in the device up to a threshold greater than an opposing resistant torque of the cam.

The tightening element can be constituted by a self-tightening cam pivoting with the safety support, the detecting roller being situated so as to be in contact for cooperating with the support for a specific position of the cam when no tightening stress is applied to the latter, and so as to no longer be in contact as soon as the cam starts its tightening action.

The centre of gravity of the cam is placed with respect to the spin axis of the latter so as to stress this cam in association with its weight in the direction of its untightening when there is no given acceleration of the device downwards, and so as to stress said cam in the opposite direction when there is acceleration of the device from an acceleration threshold to activate tightening.

According to the invention, so as to embody the third tightening effect, the device comprises a load activation lever cooperating unidirectionally with the cam by means of a stop so that this cam can only be activated by this lever in a direction provoking tightening.

According to one preferred embodiment, a linking spring mounted on the hinge pin common to the lever and cam comprises two ends, one being applied at one point of the box of the device and the other being applied to the cam so as to stress it in rotation in the untightening direction and thus constantly apply it to contact of the lever in the absence of any positive action for stopping the latter at an upper position simultaneously with a phenomenon activating tightening of the cam.

The weight of the cam associated with the positioning of its centre of gravity is calculated so as to neutralise the action of the spring to tighten the entire device under the effect of a specific downwards acceleration.

In all these cases, the starting of rotation of the cam in the tightening direction results in the automatic continuation of the tightening movement by virtue of the configuration of the face cooperating with the rope, thus provoking a self-tightening phenomenon until full locking.

The activation lever is configured and positioned in such a way as to be able to activate or accompany the cam as regards its entire travel until the rope is fully locked.

BRIEF DESCRIPTION OF THE DRAWINGS

So as to clearly understand the device of the invention, there now follows a description given by way of example of a preferred non-restrictive embodiment with reference to the accompanying drawing on which.

DETAILED DESCRIPTION OF THE PREFERRED EMBODIMENTS

Figure 1:
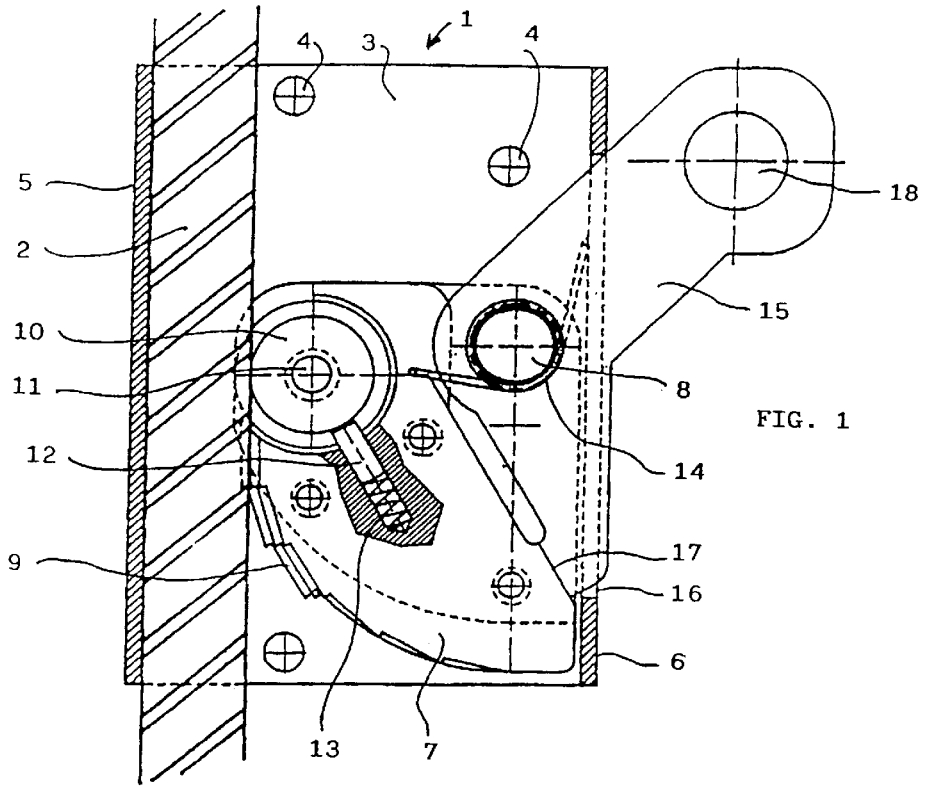
FIG. 1 is a partially vertical sectional side view of an automatic stoppage device of the present invention and shown in its rest position enabling it to move along the safety rope.

With reference to the drawing, the automatic stoppage device, generally denoted as 1, is intended to tighten a vertical safety rope 2 which traverses it. The rope 2 is fixed at its upper end and is provided with a ballast (not shown) at its lower end.

The device 1 comprises a box made up of two lateral plates 3 (only one visible on the drawing) connected by braces 4 with one frontal wall 5 and one rear wall 6.

Housed inside the box is a tightening cam 7 mounted to pivot around a horizontal pin 8 borne by the plates 3. Towards its front portion, the cam 7 has an arched tightening surface 9 and comprises at its front upper portion a detection roller 10 mounted loose on a transverse axis 11 borne by the cam 7.

Circulating in the space provided between the internal face of the frontal wall 5 and the front end of the cam 7 is a safety rope 2 whose relative movement with the device 1 drives the detecting roller 10 in rotation. The rotation of the roller 10 is halted by a friction piece 12 which engages the periphery of this roller under the stress of a spring 13 resting on the body of the cam 7. From a specific threshold of the speed of rotation of the roller, the force of the spring 13 is selected so as to apply to the roller a resistant torque with a specific level opposing the rotation of the roller and partially rendering integral the roller 10 and the cam 7.

A spring 14 wound onto the shaft 8 and pressing partly on the cam 7 and partly on the rear wall 6 acts on the cam 7 so as to keep the latter in its position shown on FIG. 1 where its tightening surface 9 does not engage the safety rope 2 and where the detecting roller 10 cooperates with this rope 2.

A bent lever 15, joined at its intermediate portion around the pin 8, has one arm which projects through an aperture 16 of the rear wall 6, whereas with the upper position of the lever 15 stopped against the wall 6 (as shown on FIG. 1), the end 17 of its other arm is used as a stop for the cam in its untightening position.

The disposition of the roller 10 on the cam 7 has been provided so that, when the cam is in a stop position against the lever 15, the roller 10 comes into contact with the rope 2.

The disposition of the cam 7 is such that its centre of gravity is placed with respect to the spin axis 8 so as to stress this cam in the untightening direction should there be no given acceleration of the device downwards, and to stress this cam in the opposite direction by means of inertia where this acceleration takes place on the basis of a specific threshold of the latter, thus then neutralising the action of the spring 14.

The arm of the lever 15, which traverses the aperture 16, has at its end an opening 18 for hooking the spring snap (not shown) of a rope associated with a worker.

It is to be noted that the lever 15 only controls movement of the cam 7 via a stop in the tightening direction. This avoids any ill-timed untightening by any ill-timed or clumsy manoeuvre of the lever.

The functioning of the device is as follows: assuming that it is situated in its non-tightening position shown on FIG. 1, because of the weight of the device 1, the projecting arm of the lever 15 is in the upper position and is situated at a level lower than the user.

As indicated earlier, the cam 7 is situated in its untightenned position in support against the stop portion 17 of the lever 15, itself in a stop position against the wall 6 under the combined effect of the weight of the cam and the spring 14. The device 1 then slides freely along the safety rope 2 upwards or downwards, depending on the movement of the user, thus driving the roller 10 in rotation.

Should the user fall, a triple effect for triggering tightening of the cam 7 is effected as follows:

a) the sudden acceleration of the falling movement of the device 1 along the rope 2 is immediately detected by the roller 10 whose speed of rotation increases until the resistant torque to which it is subjected surmounts the opposing resistant torque of the cam 7. This cam then pivots clockwise around the spindle 8 so that its tightening surface 9 engages the rope 2 and locks it against the wall 5, thus immobilising the device.

Figure 2:
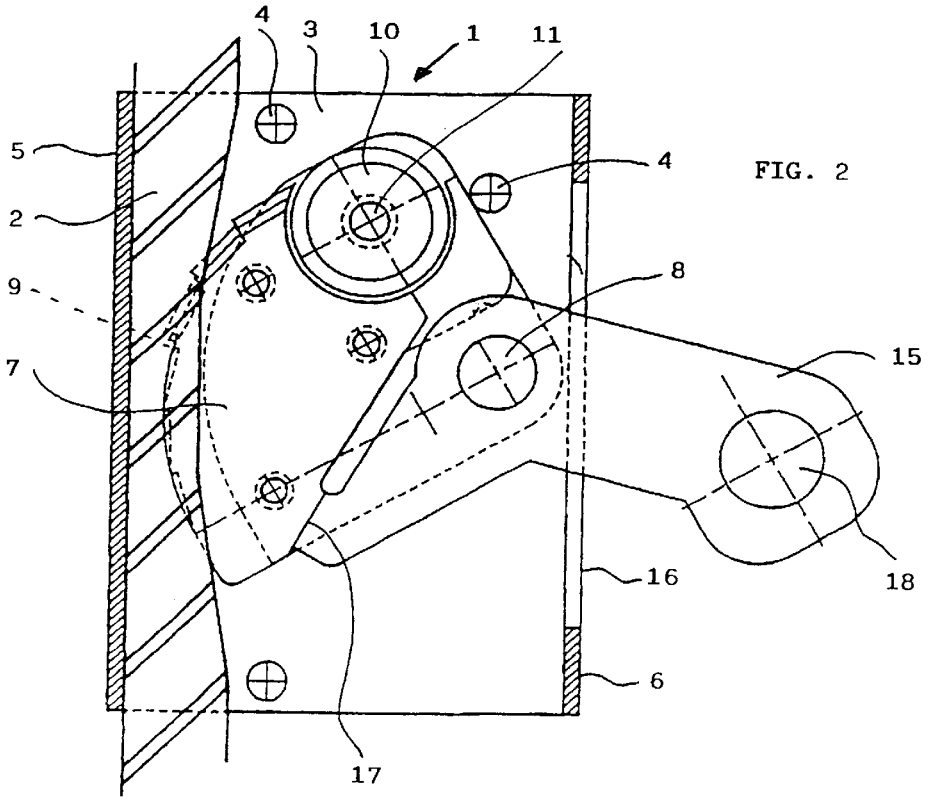
FIG. 2 is a view of the device of FIG. 1 in its stoppage position after triggering of tightening by moving the pivoting lever.
Figure 3:
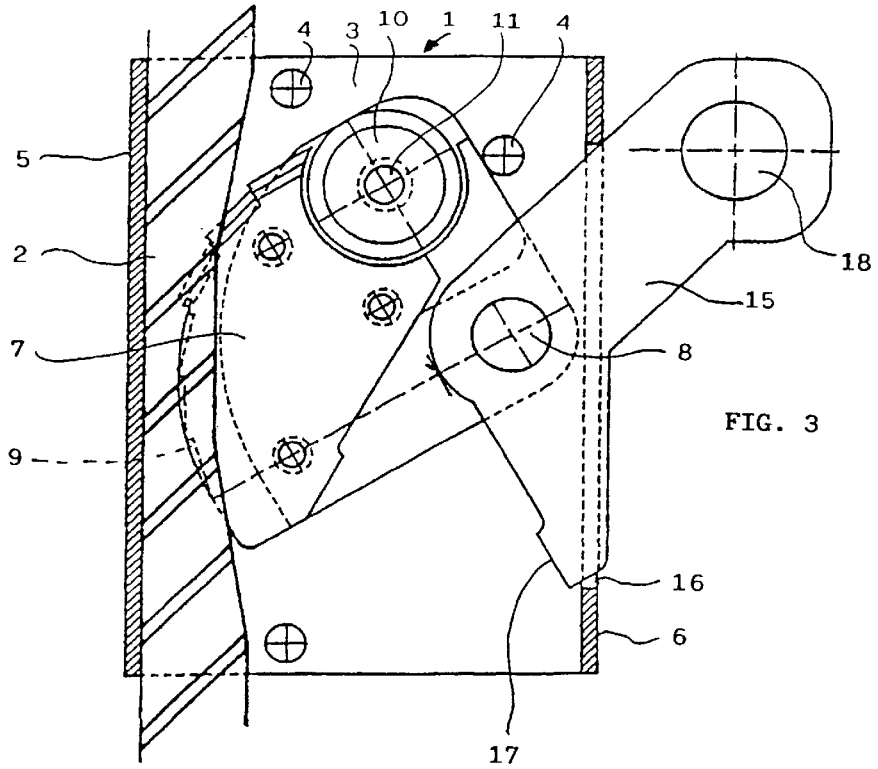
FIG. 3 is a view of the device of FIG. 1 in its stoppage position without triggering of tightening having been controlled by the lever.

As can be seen on FIG. 2, as soon as the cam 7 starts to move to tighten the rope 2, the detecting roller 10 stops cooperating with the latter, and in its maximum tightening position, the cam 7 engages a stop formed of one of the braces 4 so as to control tightening.

b) Because of the inertia of the cam 7, the sudden stressing of the device 1 downwards due to the fall triggers a pivoting movement of the latter in a direction which initiates tightening of the rope 2.

c) Under the effect of the free fall load connected to its end 18, the lever 15 pivots clockwise through its stop portion 17 acting on the cam 7 so as to bring it into its tightening position. The lever 15 accompanies the cam 7 for its entire tightening travel until the rope 2 is fully locked.

As the lever 15 pivots freely on the spindle 8, an accidental immobilisation of the latter in its rest position shown on FIG. 1 could only oppose one of the two effects described above at a) and b) or the two together to carry out tightening.

Figure 4:
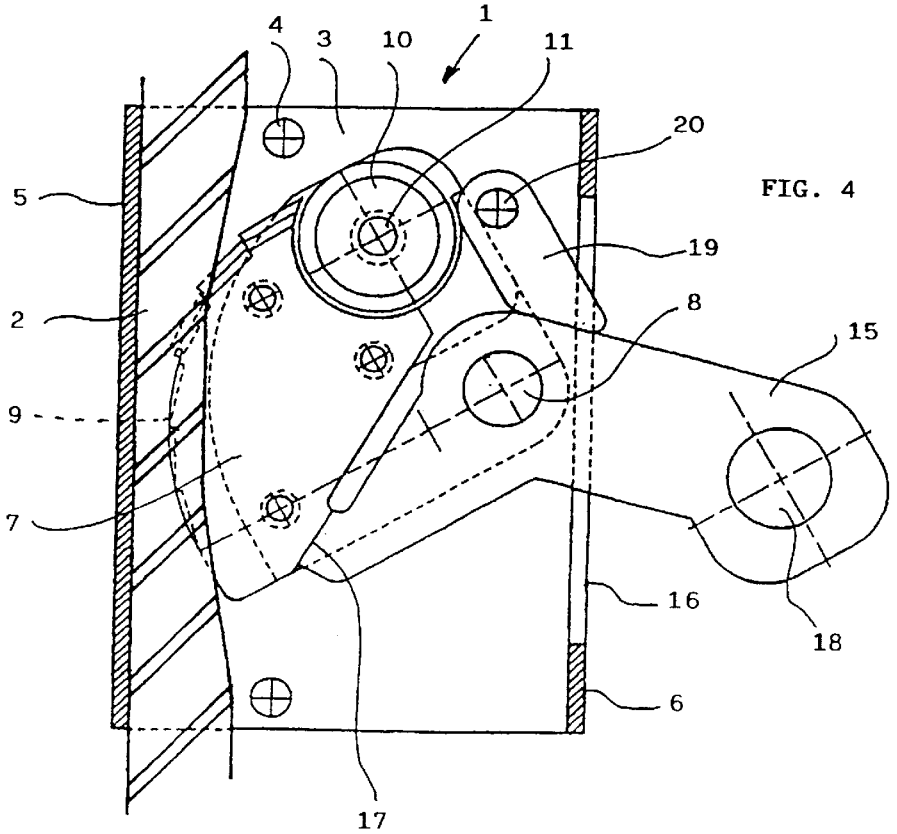
FIG. 4 is a view similar to FIG. 2, but showing the device locked in a deliberate manual stoppage position (parking).

As shown on FIG. 4, a device for locking the lever 15 in a locking position and formed, for example, of a catch 19 joined at 20 to the box and engaging the rear face of the lever 15, is able to keep the cam 7 in the rope 2 locking position, thus being used as a parking brake.

The box of the device comprises an opening element (not shown on the drawing) so that the closed position of the box is locked by two separate elements, thus requiring the intervention of two successive deliberate operations to open this box.

For the requirements of the description of the present invention, a rope has been adopted as a support for the device and a cam has been adopted as a tightening element whose tightening throat can be profiled so as to correspond to the section of the rope by means of the self-tightening of this rope. For the same needs, a roller has been used as a detector. However, without departing from the context of the invention, the same system could be constructed according to the state of the Art so as to function as a support formed of a metallic cable or rigid profile.

What is claimed is:

1. An automatic anti-fall device able to slide, without requiring any additional operation, onto a safety support fixed to a point situated above the anti-fall device, said anti-fall device for connection to a user or a load and comprising:

(a) a cam pivotally mounted within a box of the anti-fall device said box having a passage for receiving the safety support, said cam positionable in a non-tightening position against the safety support when a relative movement between the anti-fall device and the safety support is under a threshold value of acceleration or speed, and said cam being able to pivot in one direction of rotation to tighten against the safety support;

(b) a detecting roller mounted to rotate on said cam so as to cooperate with said safety support, when said cam is in its non-tightening position, with a rotating speed proportional to the speed of relative movement between the anti-fall device and the safety support; and (c) a friction system comprising a movable friction piece mounted on said cam and a spring applying said movable friction piece against the periphery of said detecting roller, so as to apply to said detecting roller a resistant torque opposing the rotation of the detecting roller and, when said threshold value is reached, rendering said detecting roller and said cam integral so as to rotate said cam in its tightening position.

2. Device according to claim 1 wherein a travel of the cam towards its non-tightening position is limited by a stop which defines a position of the detecting roller enabling said detecting roller to be driven by a relative movement of the safety support, a spring leaning against said box of the anti-fall device acts on this cam so as to urge the cam towards its non-tightening position until it reaches a stop position.

3. Device according to claim 2 wherein the center of gravity of the cam is placed with respect to a spindle of the cam so as to urge said cam, together with the action of its weight, towards its non-tightening position in the absence of a given acceleration of the anti-fall device downwards, and so as to urge said cam in an opposing direction in the presence of said given acceleration, from a threshold of said given acceleration, up to a sufficient extent to neutralize the spring action applied to the cam and to begin a self-tightening action.

4. Device according to claim 2 comprising a load activated lever cooperating unidirectionally with the cam through said stop so that an activation of said cam by the load activated lever can only take place in a direction ensuring tightening.

5. Device according to claim 4 wherein said stop limiting the travel of the cam towards the non-tightening position is ensured by the load activated lever through an abutment of said load activated lever on said box of the anti-fall device so that, in association with the spring action urging the cam, a continuous contact between the load activated lever and the cam is obtained in the absence of any action applied to the load activation lever for preventing this lever form following the cam in a tightening movement.

6. Device according to claim 1 which comprises a locking element, able to lock the cam in its tightening position.

* * * * *